US008132903B2

(12) United States Patent
Sakurai et al.

(10) Patent No.: US 8,132,903 B2
(45) Date of Patent: Mar. 13, 2012

(54) INK JET SYSTEM AND METHOD FOR REMOVING AIR BUBBLES INSIDE OF AN INK JET NOZZLE

(75) Inventors: Naoaki Sakurai, Yokohama (JP); Tsuyoshi Sato, Yokohama (JP); Hiroyasu Kondo, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 481 days.

(21) Appl. No.: 12/365,400

(22) Filed: Feb. 4, 2009

(65) Prior Publication Data

US 2009/0201352 A1 Aug. 13, 2009

(30) Foreign Application Priority Data

Feb. 7, 2008 (JP) ..... P2008-027526

(51) Int. Cl.
*B41J 2/19* (2006.01)
*B41J 2/165* (2006.01)
*B41J 2/18* (2006.01)

(52) U.S. Cl. ..... 347/92; 347/20; 347/22; 347/29; 347/30; 347/84; 347/89

(58) Field of Classification Search ..... 347/29, 347/30, 89, 92
See application file for complete search history.

(56) References Cited

U.S. PATENT DOCUMENTS

| | | | | |
|---|---|---|---|---|
| 4,908,636 | A * | 3/1990 | Saito et al. | 347/25 |
| 4,947,191 | A * | 8/1990 | Nozawa et al. | 347/30 |
| 5,128,690 | A * | 7/1992 | Nozawa | 347/30 |
| 6,231,174 | B1 * | 5/2001 | Haigo | 347/89 |
| 6,517,189 | B2 * | 2/2003 | Ogawa et al. | 347/35 |
| 7,399,075 | B2 * | 7/2008 | Nomura et al. | 347/89 |
| 7,416,288 | B2 * | 8/2008 | Takatsuka | 347/85 |

* cited by examiner

*Primary Examiner* — Ryan Lepisto
(74) *Attorney, Agent, or Firm* — Oblon, Spivak, McClelland, Maier & Neustadt, L.L.P.

(57) ABSTRACT

An ink jet system according to the present invention is provided with an air bubble removing unit including: an ink jet body having a plurality of ink supply path; a nozzle plate connected to an end of the ink jet body and having a plurality of spaced nozzle holes therein; and a cap configured to cover the nozzle holes formed in the nozzle plate wherein a first ink channel space is formed continuous to the nozzle holes and the plurality of ink supply path, and a second ink channel space is formed between a recess of the cap and a surface of the nozzle plate, so that the second ink channel space and the first ink channel space are continuous through the nozzle holes.

9 Claims, 6 Drawing Sheets

INK JET SYSTEM AND METHOD FOR REMOVING AIR BUBBLES INSIDE OF AN INK JET NOZZLE

CROSS-REFERENCE TO RELATED APPLICATIONS AND INCORPORATION BY REFERENCE

This application claims benefit of priority under 35 USC 119 based on Japanese Patent Application P2008-27526, filed Feb. 7, 2008, the entire contents of which are incorporated by reference herein.

BACKGROUND OF THE INVENTION

1. Field of the Invention

The present invention relates to an ink jet system and a method for removing an air bubble from the inside of an ink jet nozzle.

2. Description of the Related Art

An ink jet printing method is used for spraying fine droplets of ink directly onto a printing medium, so as to print indicia thereon. The ink can be sprayed onto the print medium by use of a simple mechanism, and therefore, the method can be utilized in various fields. For example, in the field of semiconductor technology, an ink jet print system has become a focus of attention as a technique for forming a pattern on a liquid crystal.

In the case where a pattern is formed on a liquid crystal by the resist, many processes are required, including mounting a cap on the liquid crystal, followed by etching, and the like. In contrast, when ink is applied by an ink jet device, the pattern can be formed directly on a liquid crystal substrate without either a cap mounting process or an etching process. As a consequence, the processes can be simplified and the amount of organic solvent can be reduced. Thus, a method of applying ink using an ink jet device has becomes a focus of attention in the field of semiconductor technology.

In this case, in order to form a high density pattern, ink needs to be sprayed in a fine pitch. However, if an air bubble adheres to a nozzle side surface of a nozzle plate in the ink jet device, the ink cannot flow straight, thereby making it difficult to apply the ink in a fine pitch.

One way of solving the above-described problem, for example, is to introduce gas to flow into an ink supply tank containing the ink before use of the ink, followed by degassing, so as to inhibit the gas from intruding into the nozzle. However, gas contained in the ink as an air bubble could not be completely prevented from flowing into the nozzle. As a result, the ink jet device was disassembled, and then, the inside of the nozzle of the nozzle plate was cleaned to wash out the air bubble. Therefore, problems arose as to complicated work processing and degradation of continuous operation of the device.

Hence, a method for removing an air bubble from inside the ink jet nozzle has been demanded.

SUMMARY OF THE INVENTION

A first aspect of the present invention relates to an ink jet system having : an air bubble removing unit including: an ink jet body having a plurality of ink supply path; a nozzle plate connected to an end of the ink jet body and having a plurality of spaced nozzle holes therein; and a cap configured to cover the nozzle holes formed in the nozzle plate wherein a first ink channel space is formed continuous to the nozzle holes and the plurality of ink supply path, and a second ink channel space is formed between a recess of the cap and a surface of the nozzle plate, so that the second ink channel space and the first ink channel space are continuous through the nozzle holes.

A second aspect of the present invention relates to a method for removing air bubbles in an ink jet comprising an ink jet body having a plurality of ink supply path and a nozzle plate connected to an end of the ink jet body and having a plurality of spaced nozzle holes therein, a first ink channel space is formed continuous to the nozzle holes and a second ink channel space is formed between a recess of a cap covering the nozzle plate and a surface of the nozzle plate, the second ink channel space and the first ink channel space are continuous through the nozzle holes; the method comprising: filling ink into the first ink channel space and the second ink channel space; and applying a pressure to the ink, so as to dissolve air bubbles in the ink in accordance with Henry's law.

DETAILED DESCRIPTION OF THE INVENTION

Figure 1:
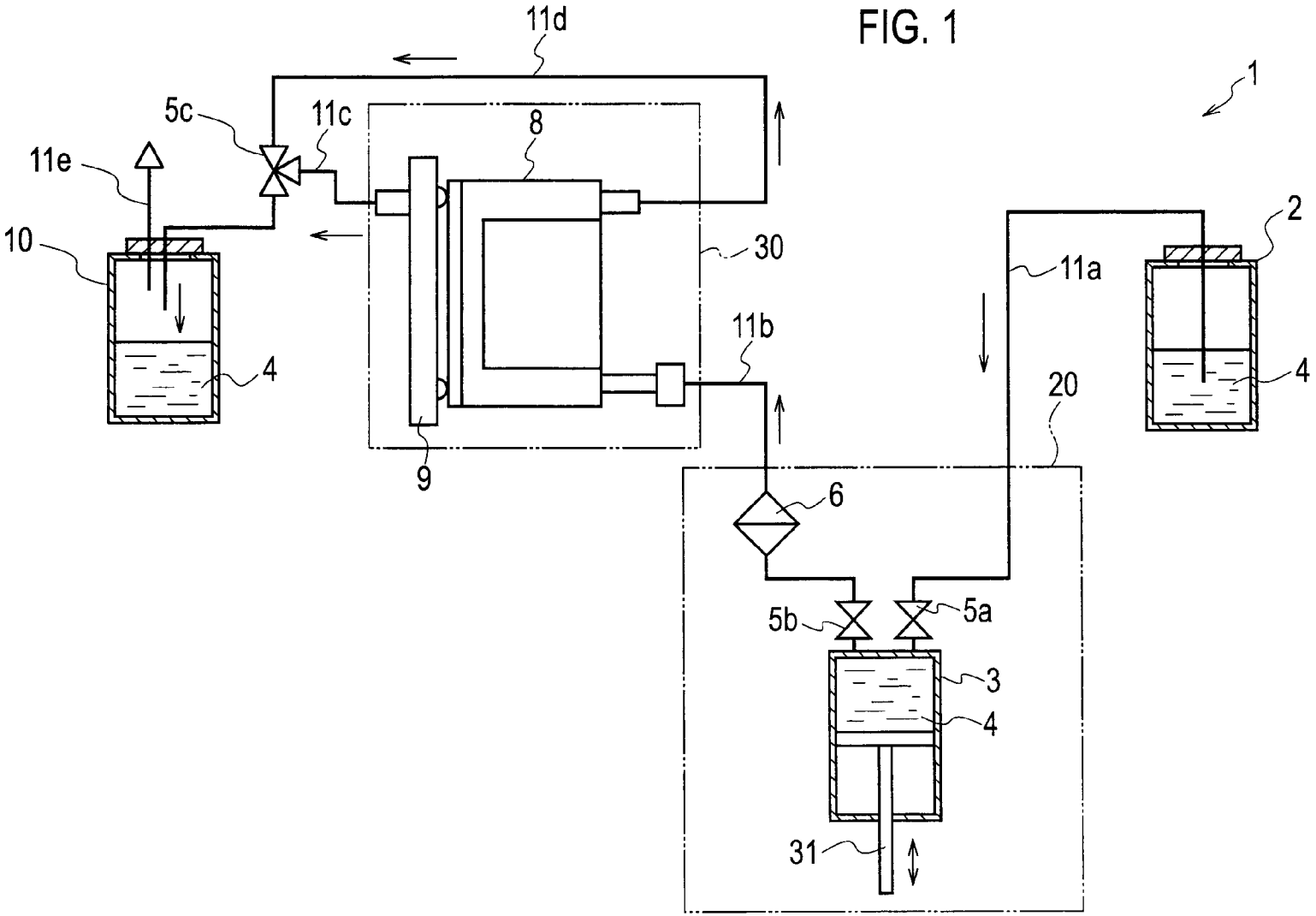
FIG. 1 is a view schematically showing an ink jet system housed inside of an ink jet nozzle for use in a first embodiment.

A description will be given below by way of embodiments according to the present invention, which is not limited thereto. Here, constituent components having the same or similar functions are designated by the same or similar reference numerals, and therefore, their explanation will be omitted below.

An object of the present invention is to increase the solubility of an air bubble dispersed in ink, so as to remove the air bubble from inside of an ink jet nozzle. According to the present invention, the air bubble inside of the ink jet nozzle can be removed by increasing the solubility of the air bubble dispersed in the ink.

First Embodiment (Ink Jet System)

An ink jet system 1 for use in a first embodiment shown in FIG. 1 includes an ink supply tank 2 for containing ink 4 therein, a plunger pump 20, an inert gas unit 6 for supplying an inert gas to ink 4 contained inside the plunger pump 20, an air bubble removing unit 30, and an ink recovery tank 10. The ink supply tank 2 and the plunger pump 20 are connected to each other via a conduit 11*a*. The plunger pump 20 and an ink jet 8 are connected to each other via a conduit 11*b*. The ink jet 8 and the ink recovery tank 10 are connected to each other via a conduit 11*d*. A cap 9 is connected to the ink recovery tank 10 via a conduit 11*c*. Ink that has been recovered from the system is returned to the ink recovery tank 10 and can be subsequently returned to the ink supply tank 2 via a conduit 11*e*.

Figure 2:
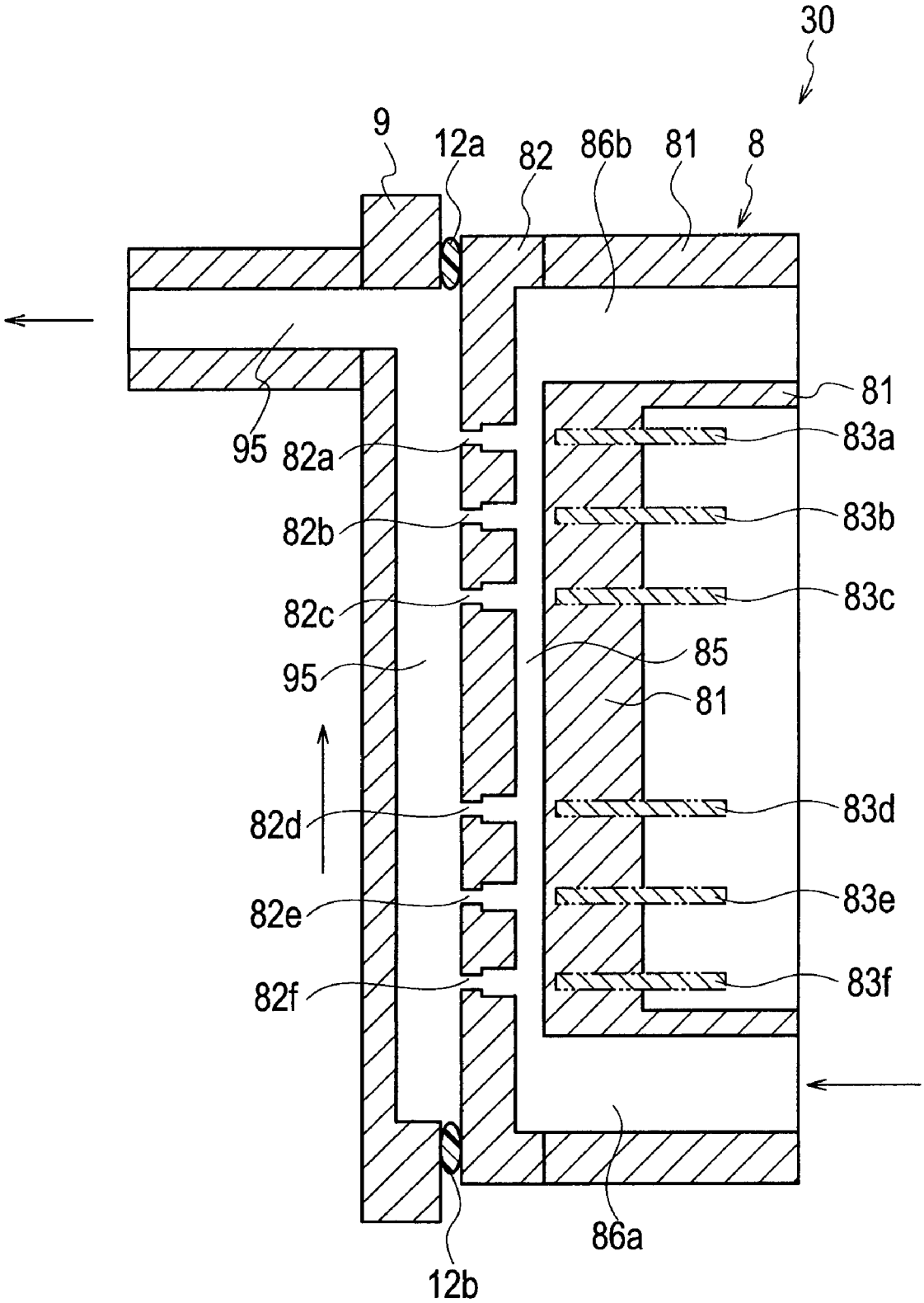
FIG. 2 is a cross-sectional view showing an air bubble removing unit including an ink jet and a cap.

The bubble removing unit 30 shown in FIG. 2 includes the ink jet body 81 having a plurality of ink supply path 86*a* and 86*b* formed therein; and a nozzle plate 82 connected to an end of the ink jet body 81 and having a plurality of nozzle holes 82*a*, 82*b*, 82*c*, 82*d*, 82*e*, and 82*f* therein; and the cap 9 configured to cover the nozzle holes 82*a* to 82*f* in the nozzle plate 82.

When the nozzle plate 82 is attached to the ink jet body 81, a first ink channel space 85 is formed continuous to the plurality of nozzle holes 82*a* to 82*f* and the plurality of ink supply path 86*a* and 86*b*, and a second ink channel space 95 is formed between a recess of the cap 9 and the surface of the nozzle plate 82, so that the second ink channel space 95 and the first ink channel space 85 are continuous through the nozzle holes 82*a* to 82*f*. The cap 9 is attached to the surface of the nozzle plate 82 via packings 12*a* and 12*b* so as to cover the nozzle holes 82*a* to 82*f* of the nozzle plate 82.

The plunger pump 20 includes a suction tank 3, a vertically movable piston 31, valves 5*a* and 5*b*, and the inert gas unit 6. After the valve Sa is opened, the piston 31 is moved toward a bottom dead center shown in FIG. 4B, so as to suction the ink 4. After the valve 5*b* is opened, the piston 31 is moved toward a top dead center shown in FIG. 6B, so that the ink 4 can be supplied to the ink jet 8. The amount of the ink 4 can be accurately measured by the plunger pump 20. Pressure can be applied to the ink 4 by the movement of the piston 31. It is preferable to feed an inert gas to the ink 4 contained in the plunger pump 20 by actuating the inert gas unit 6, so as to degas the ink 4. If air bubbles contained in the ink 4 are removed prior to the printing process, the number of air bubbles adhering to a nozzle side surface 82*anw* shown in FIG. 7 can be remarkably reduced. The air bubbles still remaining in the ink 4 after reducing the number of air bubbles can be removed by actuating the air bubble removing unit 30 of the embodiment.

Although FIG. 2 shows the state in which the cap 9 is attached to the ink jet 8, the ink 4 in the first ink channel space 85 is ejected by actuating air ejection ports 83*a*, 83*b*, 83*c*, 83*d*, 83*e*, and 83*f* spaced in the ink jet body 81 in such a manner as to correspond to the nozzle holes 82*a* to 82*f*, respectively, after the cap 9 is detached.

(Method for Removing Air Bubble Inside the Ink Jet Nozzle)

(a) The ink jet system 1 shown in FIG. 1 is prepared.

Figure 3A:
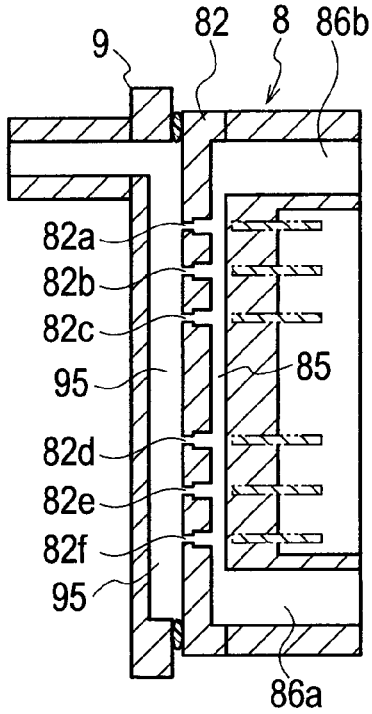
FIG. 3A is a view illustrating the use state of the ink jet and the cap.
Figure 3B:
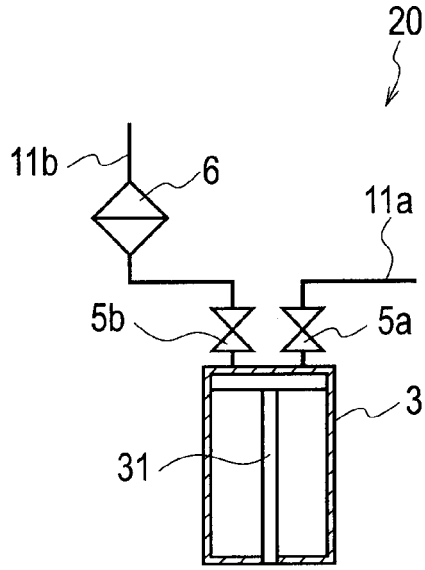
FIG. 3B is a view illustrating the use state of a plunger pump.

(b) The first ink channel space 85 and the second ink channel space 95, which are connected to each other via the nozzle holes 82*a* to 82*f*, are closed. Specifically, the valve 5*c* shown in FIG. 1 is closed to form a closed system via the ink jet 8, the cap 9, and the conduits 11*c* and 11*d*. Here, the plunger pump 20 is not actuated, as shown in FIG. 3B.

Figure 4A:
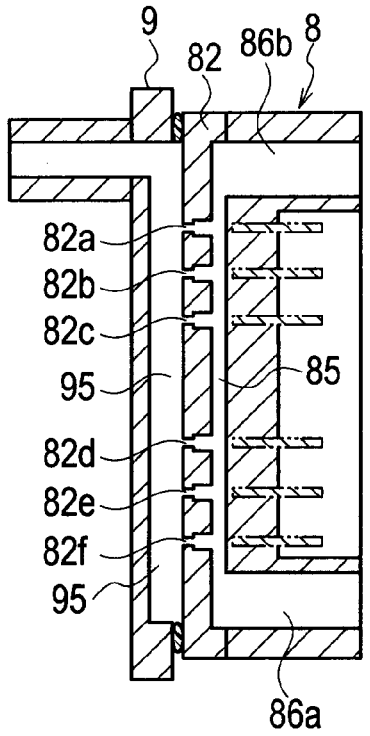
FIG. 4A is a view illustrating the use state of the ink jet and the cap.
Figure 4B:
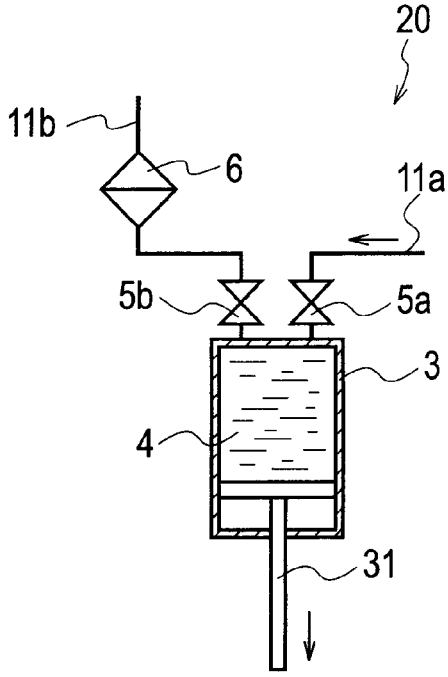
FIG. 4B is a view illustrating the use state of the plunger pump.
Figure 5A:
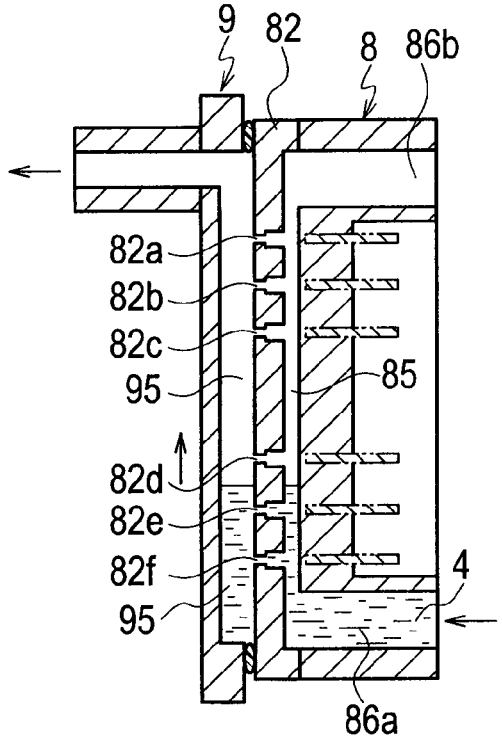
FIG. 5A is a view illustrating the use state of the ink jet and the cap.
Figure 5B:
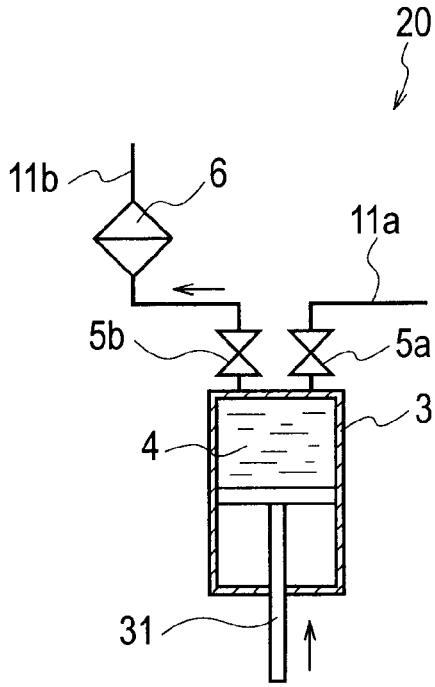
FIG. 5B is a view illustrating the use state of the plunger pump.

(c) The first ink channel space 85 and the second ink channel space 95 are filled with ink. Specifically, the plunger pump 20 is actuated, as shown in FIG. 4B. Then, the ink 4 is suctioned from the ink supply tank 2 shown in FIG. 1 via the conduit 11*a*. It is preferable to degas the ink 4 by actuating the inert gas unit 6. Here, the first ink channel space 85 and the second ink channel space 95 have not been filled with ink yet, as shown in FIG. 4A. Then, the piston 31 in the plunger pump 20 is moved, as shown in FIG. 5B, and the first ink channel space 85 and the second ink channel space 95 are filled with previously degassed ink 4, as shown in FIG. 5A.

Figure 6A:
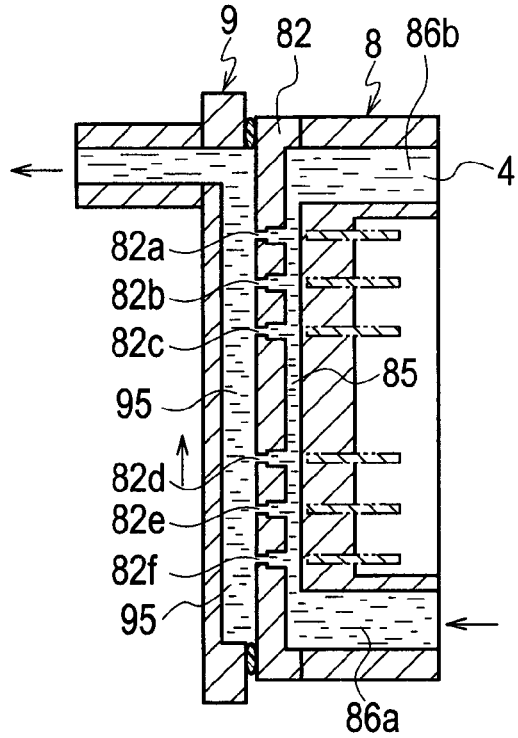
FIG. 6A is a view illustrating the use state of the ink jet and the cap.
Figure 6B:
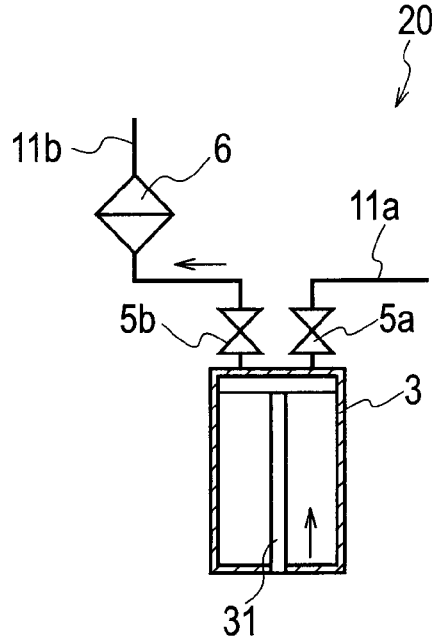
FIG. 6B is a view illustrating the use state of the plunger pump.
Figure 7:
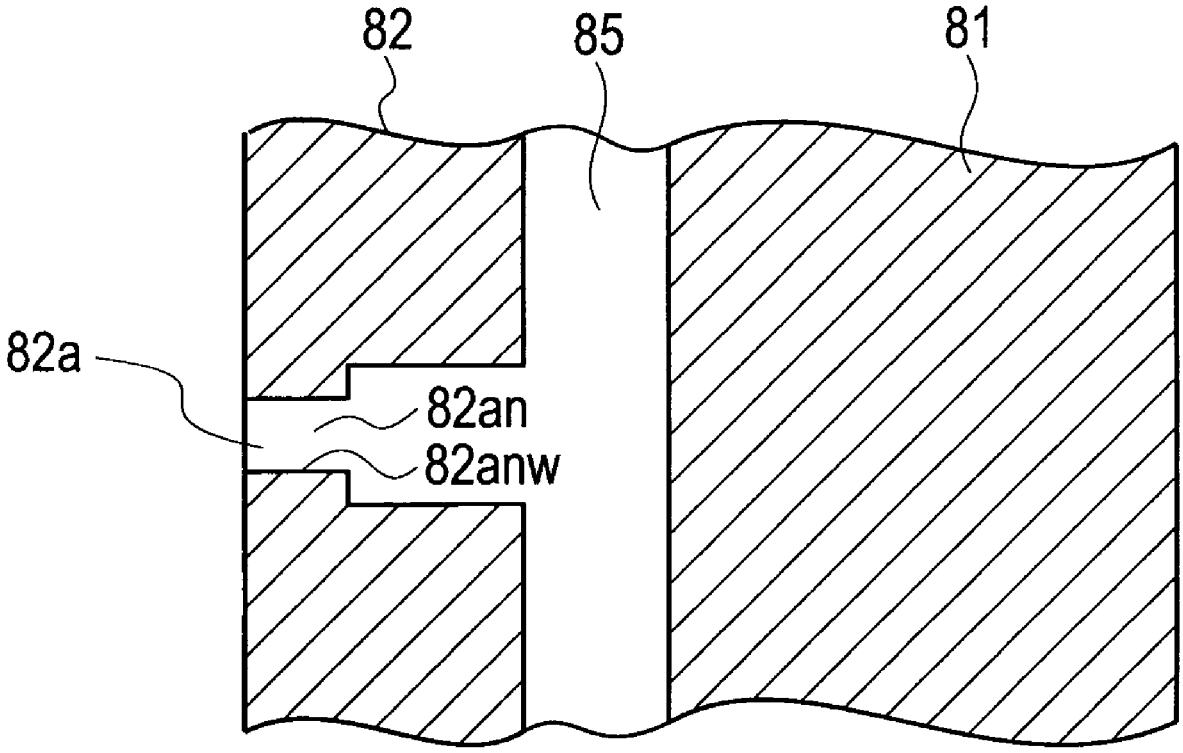
FIG. 7 is a cross-sectional view showing, in partly enlargement, the air bubble removing unit including the ink jet and the cap.

(d) A pressure is applied to the ink 4, and air bubbles are dissolved in the ink 4 in accordance with Henry's law. Specifically, a pressure is applied to the ink 4 flowing in either one of the first ink channel space 85 and the second ink channel space 95. Here, the piston 31 in the plunger pump 20 is moved, as shown in FIG. 6B, and pressure is applied to the ink 4 flowing in the first ink channel space 85, as shown in FIG. 5A. In other words, pressure is applied to the ink 4 flowing in the first ink channel space 85 from a reverse side of the nozzle plate 82. The pressure is preferably in a range of about 150 KPa to about 2 MPa. If the pressure is lower than a lower limit, it is difficult to dissolve the air bubbles in the ink 4. In contrast, if the pressure exceeds an upper limit, the effect produced cannot be extremely varied.

(e) The pressure applied to the ink is moderately decreased at about 1 KPa/min. to about 100 KPa/min. If the pressure is rapidly decreased, the pressure will lose uniformity. Here, the pressure is applied to the ink 4 flowing in the first ink channel space 85, so that the pressure of the ink 4 is uniform everywhere inside the closed space.

(f) When the pressure applied to the ink reaches about 98 KPa or less, the cap 9 is detached. In the above-described procedures, the air bubbles inside the ink jet 8 can be removed.

In accordance with "Henry's law", in the case of gas having low solubility and does not react with a solvent, the mass of the gas to be dissolved in a defined amount of solvent at a given temperature is proportional to a pressure of the gas in contact with the solvent. Air bubbles contained in the ink 4 have a low solubility with respect to the ink 4. Therefore, the air bubbles do not react with the ink 4. Therefore, the air bubbles are dissolved in proportion to the pressure applied to the ink 4 in accordance with Henry's law. As a consequence, the air bubbles in the ink 4 are dissolved and removed from the ink 4, adhered to the nozzle side surface 82*anw* of a nozzle 82*an* shown in an enlargement view of the nozzle hole 82*a* inside of the ink jet 8 in FIG. 7.

An ink was prepared so as to have air bubbles therein. The air bubble removing method in the first embodiment was implemented with respect to 60 ink jets for 60 seconds. As a result, the air bubbles inside the nozzle could be removed in all of the ink jets. In contrast, air bubbles inside the nozzle could be removed in only 3 out of all of the 60 ink jets in the case where the ink is only degassed.

Second Embodiment (Ink Jet System)

Figure 8:
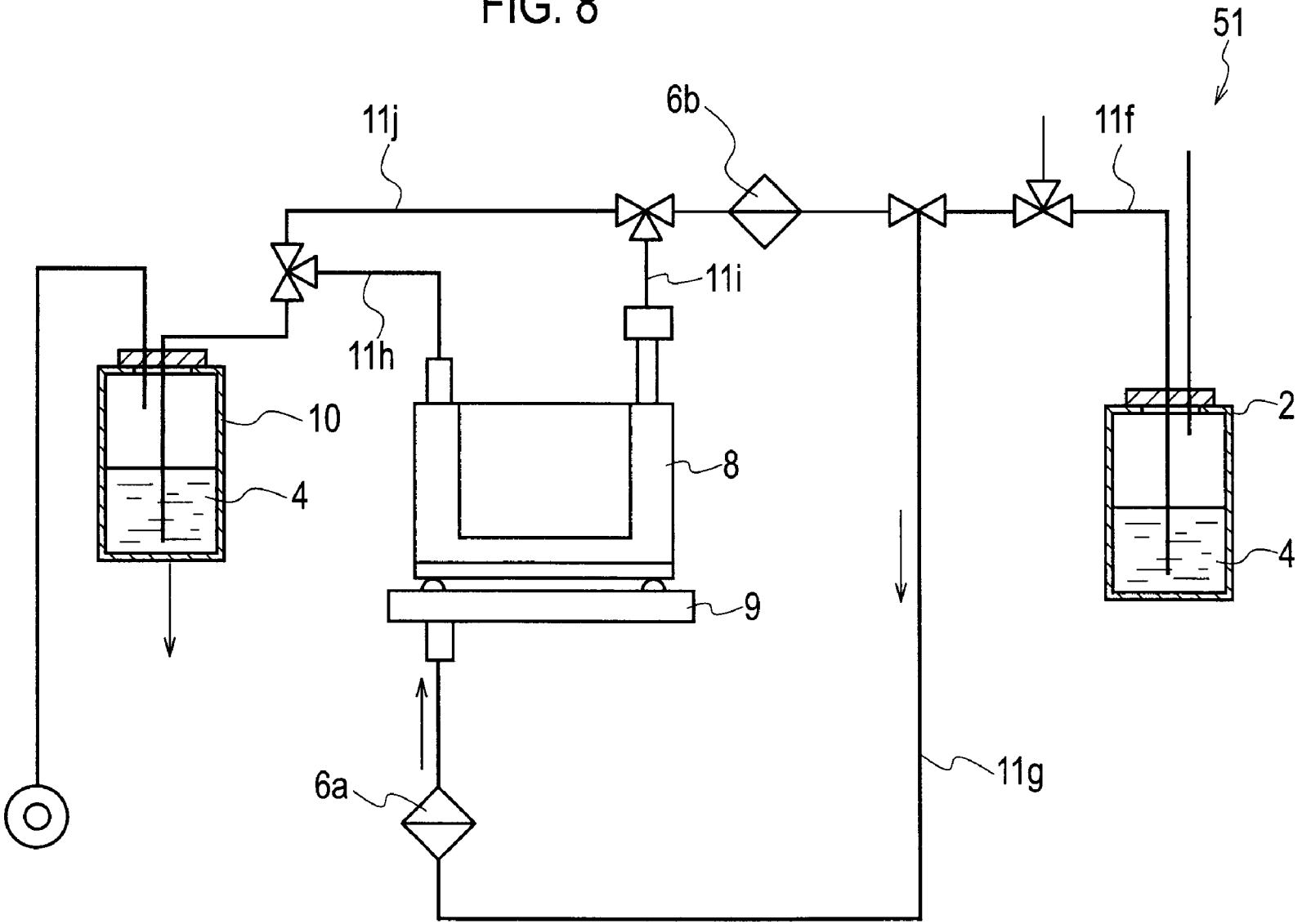
FIG. 8 is a view schematically showing an ink jet system housed inside of an ink jet nozzle for use in a second embodiment.

Explanation will be made on mainly a difference between a second embodiment and the first embodiment. An ink jet system 51 for use in the second embodiment illustrated in FIG. 8 includes an ink supply tank 2 containing an ink 4 therein, a cap 9 disposed opposite to an ink jet 8, the ink jet 8, and an ink recovery tank 10. The ink supply tank 2 and the cap 9 are connected to each other via conduits 11*f* and 11*g*: in the meantime, the ink jet 8 and the ink recovery tank 10 are connected to each other via conduits 11*h* and 11*i*.

With the method for removing air bubbles from inside an ink jet nozzle in the second embodiment using the ink jet system 51 configured inside the ink jet nozzle, a pressure is applied to the ink 4 of the second ink channel space 95 and a first ink channel space 85 from a surface side of a nozzle plate 82. The pressure applying method is identical to that of the method for removing the air bubbles inside the ink jet nozzle of the first embodiment. In the second embodiment, the air bubbles inside of the ink jet nozzle can be removed in the same manner as in the first embodiment. The first embodiment and the second embodiment may be used in combination.

Other Embodiments

As described above, although the present invention has been described by way of the embodiments, it is to be understood that the description and the drawings composing a part of the disclosure should not limit the present invention. From this disclosure, various alternative modes, examples, and operational techniques are obvious for one skilled in the art. For example, although the ink 4 is supplied to the first ink channel space 85 and the second ink channel space 95 to increase the pressure in the embodiments, an inert gas may be fed into the first ink channel space 85 and the second ink channel space 95, to thus apply a pressure to the ink 4.

In this manner, it is, of course, to be understood that the present invention should include various embodiments, although they are not described herein. As a consequence, a technical range according to the present invention shall be determined only by an invention specifying matter encompassed within a scope of claims which seems proper from the above description.

What is claimed is:

1. An ink jet system comprising:

an air bubble removing unit including:

an ink jet body having a plurality of ink supply paths;

a nozzle plate connected to an end of the ink jet body and having a plurality of spaced nozzle holes therein; and a cap configured to cover the nozzle holes formed in the nozzle plate;

wherein a first ink channel space is formed continuous to the nozzle holes and the plurality of ink supply paths, and a second ink channel space is formed between a recess of the cap and a surface of the nozzle plate, so that the second ink channel space and the first ink channel space are continuous through the nozzle holes, the air bubble removing unit further includes a plunger pump connected to the first ink channel space and configured to remove the air bubbles still remaining in the ink after reducing the number of air bubbles.

2. The ink jet system of claim 1, wherein the air bubble removing unit further includes an inert gas unit connected to the first ink channel space.

3. The ink jet system of claim 1, wherein a bore portion having a diameter larger than the diameter of the nozzle hole is provided on the first ink channel side surface of the nozzle plate, the nozzle hole is provided from a bottom surface of the bore portion to the second ink channel side surface of the nozzle plate, and throughout the nozzle hole its whole diameter is approximately the same.

4. A method for removing air bubbles in an ink jet comprising an ink jet body having a plurality of ink supply paths and a nozzle plate connected to an end of the ink jet body and having a plurality of spaced nozzle holes therein, a first ink channel space is formed continuous to the nozzle holes and a second ink channel space is formed between a recess of a cap covering the nozzle plate and a surface of the nozzle plate, the second ink channel space and the first ink channel space are continuous through the nozzle holes; the method comprising:

filling ink into the first ink channel space and the second ink channel space;

applying a pressure to the ink, so as to dissolve air bubbles in the ink in accordance with Henry's law; and after applying the pressure to the ink, moderately decreasing the pressure from about 1 KPa/min. to about 100 KPa/min.; and detaching the cap when the pressure is 98 KPa or less.

5. The method of claim 4, wherein the pressure is applied to the ink inside of the first ink channel space.

6. The method of claim 5, wherein the pressure is applied to the ink inside of the second ink channel space.

7. The method of claim 4, wherein after filling the ink into the first ink channel space and the second ink channel space, an inert gas is fed into the first ink channel space and the second ink channel space, so that the pressure is applied to the ink.

8. The method of claim 4, wherein the ink is partially degassed before being pressurized.

9. The method of claim 4, wherein the pressure is set in a range from about 150 KPa to about 2 MPa.

* * * * *